US010428808B2

(12) United States Patent
Humburg

(10) Patent No.: US 10,428,808 B2
(45) Date of Patent: Oct. 1, 2019

(54) PUMP, ESPECIALLY FOR DELIVERING LIQUID FUEL FOR A VEHICLE HEATER

(71) Applicant: Eberspächer Climate Control Systems GmbH & Co. KG, Esslingen (DE)

(72) Inventor: Michael Humburg, Göppingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 343 days.

(21) Appl. No.: 14/522,823

(22) Filed: Oct. 24, 2014

(65) Prior Publication Data

US 2015/0118077 A1 Apr. 30, 2015

(30) Foreign Application Priority Data

Oct. 25, 2013 (DE) ..... 10 2013 221 744

(51) Int. Cl.

| | |
|---|---|
| ***F04B 17/00*** | (2006.01) |
| ***F04B 43/09*** | (2006.01) |
| ***F04B 49/22*** | (2006.01) |
| ***F04B 53/10*** | (2006.01) |
| ***F23K 5/04*** | (2006.01) |
| ***F04B 17/03*** | (2006.01) |

(52) U.S. Cl.

CPC ..... *F04B 17/003* (2013.01); *F04B 17/00* (2013.01); *F04B 17/03* (2013.01); *F04B 43/09* (2013.01); *F04B 43/095* (2013.01); *F04B 49/225* (2013.01); *F04B 53/1002* (2013.01); *F23K 5/04* (2013.01); *F23K 2301/201* (2013.01)

(58) Field of Classification Search

CPC ..... F04B 17/003; F04B 17/00; F04B 43/09; F04B 43/08

USPC ..... 417/478, 479, 322

See application file for complete search history.

(56) References Cited

U.S. PATENT DOCUMENTS

| | | | |
|---|---|---|---|
| 5,129,789 A | 7/1992 | Thornton et al. | |
| 6,050,787 A | 4/2000 | Hesketh | |
| 9,091,251 B1 * | 7/2015 | Ullakko | G01N 21/75 |

(Continued)

FOREIGN PATENT DOCUMENTS

| | | |
|---|---|---|
| CN | 101087957 A | 12/2007 |
| CN | 101260878 A | 9/2008 |

(Continued)

OTHER PUBLICATIONS

Translation of RU 2065995 C1, Gurov Ivan Ivanovich, "Pump", Aug. 1996, Russia.*

(Continued)

*Primary Examiner* — Charles G Freay
*Assistant Examiner* — Lilya Pekarskaya
(74) *Attorney, Agent, or Firm* — McGlew and Tuttle, P.C.

(57) ABSTRACT

A pump, especially for delivering liquid fuel for a vehicle heater, includes a pump body (12) providing a pump chamber (14). The pump body (12) is made with magnetic shape memory material at least in some areas. The pump further includes a field-generating arrangement (44) for generating a magnetic field (M). The magnetic shape memory material of the pump body (12) can be brought from an initial state into a deformed state by generating a magnetic field (M) by the field-generating arrangement (44). A pump chamber volume in the deformed state differs from the pump chamber volume present in the initial state.

20 Claims, 3 Drawing Sheets

(56) References Cited

U.S. PATENT DOCUMENTS

| | | | | |
|---|---|---|---|---|
| 2006/0127247 | A1* | 6/2006 | Caddell | F04B 43/09 417/413.1 |
| 2009/0033448 | A1* | 2/2009 | Hoang | F02M 51/0603 335/215 |
| 2012/0026387 | A1* | 2/2012 | Kosaka | F03G 7/065 348/357 |
| 2013/0183174 | A1* | 7/2013 | Hampton | F04B 17/04 417/410.1 |

FOREIGN PATENT DOCUMENTS

| | | | |
|---|---|---|---|
| CN | 202023723 | U | 11/2011 |
| DE | 33 38 626 | A1 | 7/1984 |
| DE | 4029249 | A1 | 3/1992 |
| DE | 10 2007 042 791 | A1 | 3/2009 |
| DE | 10 2011 003 505 | A1 | 8/2012 |
| EP | 1813803 | A1 * | 8/2007 |
| GB | 2054062 | A | 2/1981 |
| JP | S6198980 | A | 5/1986 |
| JP | 2001280215 | A * | 10/2001 |
| RU | 2065995 | C1 * | 8/1996 |
| RU | 2161853 | C2 | 1/2001 |
| WO | 97/03472 | A1 | 1/1997 |
| WO | 2006063267 | A1 | 6/2006 |

OTHER PUBLICATIONS

Raw Machine Translation of JP2001-280215A, Kono, Ryuko, " Magnetic shape memory type fuel injection valve for internal combustion engine", 2001, Japan.*

Sun, Jingwen, Chinese Doctoral Dissertations & Master's Theses Full-text Database, Engineering Science and Technology I, Issue 05, Nov. 15, 2007, p. 13.

Chinese Search Report.

* cited by examiner

PUMP, ESPECIALLY FOR DELIVERING LIQUID FUEL FOR A VEHICLE HEATER

CROSS REFERENCE TO RELATED APPLICATIONS

This application claims the benefit of priority under 35 U.S.C. § 119 of German Patent Application DE 10 2013 221 744.7 filed Oct. 25, 2013, the entire contents of which are incorporated herein by reference.

FIELD OF THE INVENTION

The present invention pertains to a pump, which can be used in an especially advantageous manner to deliver liquid fuel in fuel-operated vehicle heaters from a fuel reservoir in the direction of a combustion chamber.

BACKGROUND OF THE INVENTION

Such pumps are built, in general, with a pump chamber, in which liquid fuel is taken up and then ejected intermittently during the delivery operation. To generate the necessary vacuum to take up liquid fuel, as well as to eject fuel from the pump chamber, a piston may be moved to and fro, so that a defined volume of liquid is delivered during each stroke of the piston and the liquid to be delivered can thus be released in a correspondingly accurately metered quantity.

SUMMARY OF THE INVENTION

An object of the present invention is to provide a pump, especially for delivering liquid fuel for a vehicle heater, in which the delivery of even small volumes of liquid is possible with high metering precision with a simple structural design and high reliability of operation.

This object is accomplished according to the present invention by a pump, especially for delivering liquid fuel for a vehicle heater, comprising a pump body providing a pump chamber. The pump body is made, at least in some areas, with a magnetic shape memory material. The pump further comprises a field-generating arrangement for generating a magnetic field, wherein the magnetic shape memory material of the pump body can be brought from an initial state into a deformed state by generating a magnetic field by the field-generating arrangement. A pump chamber volume in the deformed state differs from the pump chamber volume in the initial state.

The present invention uses the effect that by generating a magnetic field, the magnetic shape memory material of the pump body changes its shape and, along with it, the volume of the pump chamber. The pump chamber volume can thus be increased and reduced in case of a corresponding intermittent generation of a magnetic field in order to take up liquid to be delivered in a suction cycle or uptake cycle in the pump chamber, on the one hand, and to release this liquid from the pump chamber in the direction of the system to be fed during an ejection cycle, on the other. No component comparable to a pump piston or the like, which would have to be moved to and fro in a pump chamber and would have to be sealed in a fluid-tight manner in order to prevent leakage flows, is necessary. Since the change in the shape of the magnetic shape memory material that can be achieved by generating a magnetic field is reproducible with very high precision, the quantity of the liquid delivered by such a pump can be correspondingly metered with high precision.

The pump chamber volume is advantageously smaller in the deformed state than in the initial state. For example, the pump body may have an essentially tubular design, i.e., it may have an essentially cylindrical design. The pump body may have an essentially round inner cross-sectional geometry in the initial state. A round inner cross-sectional geometry means that the pump chamber volume has its maximum in this state and a reduction of the pump chamber volume is generated, for example, when a flattened, elliptical cross-sectional geometry is generated.

To make it possible to preset a defined direction of flow of the liquid to be delivered during a change in the pump chamber volume, it is proposed that an inlet valve leading to the pump chamber and an outlet valve leading out of the pump chamber be provided. Provisions may be made in an advantageous embodiment, which does not require any additional measures for actuation for the inlet valve or/and the outlet valve to comprise a nonreturn valve.

To support or achieve a reverse deformation of the pump body into its initial state that is present when no magnetic field is present, it is proposed, further, that a resetting arrangement for resetting the pump body into its initial state be associated with the pump body. This resetting arrangement may become active, for example, when the generation of a magnetic field by the field-generating arrangement is stopped and there is consequently no field any more that would act on or deform the pump body in the direction of the deformed state thereof. For example, the resetting arrangement may comprise a prestressing arrangement for prestressing the pump body preferably by means of a prestressing spring into its initial state.

To obtain information on the change in the volume of the pump chamber in connection with the deformation of the pump body in case of the design according to the present invention, it is proposed that a deformation detection arrangement be provided for generating information representing the deformation of the pump body. It is proposed in an especially advantageous embodiment, which utilizes the effect that in a magnetic shape memory material, the electric resistance of this material changes as a function of the state of deformation, it is proposed that the deformation detection arrangement generate information representing the deformation on the basis of an electric resistance of the pump body.

The pump body may be advantageously made with an NiMnGa alloy material.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
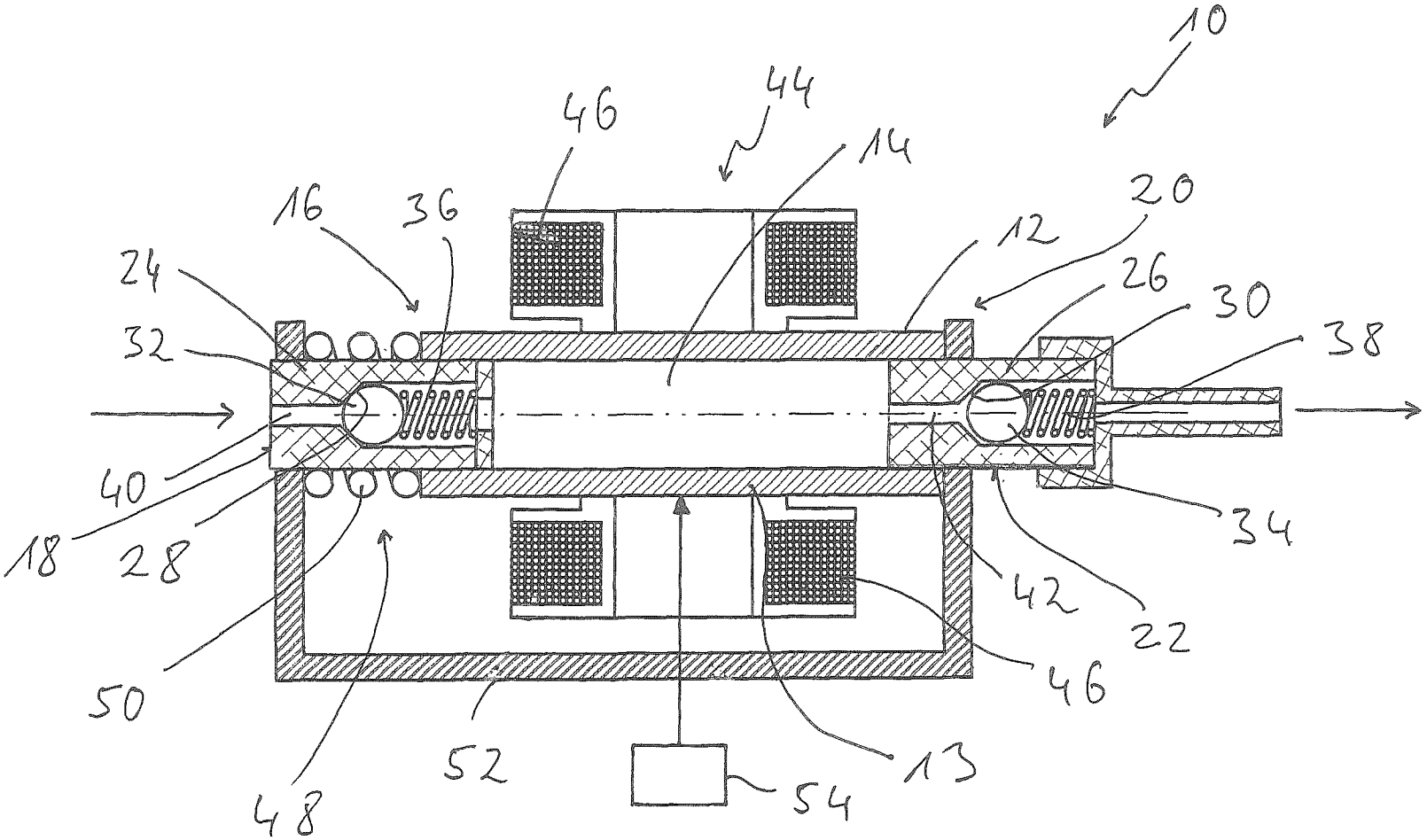
FIG. 1 is a sectional view of a pump with a pump body made of magnetic shape memory material in a state without magnetic field.

Referring to the drawings in particular, a pump, which can be used, for example, to deliver liquid fuel in a vehicle heater, is generally designated by 10 in FIG. 1. Pump 10 comprises a pump body 12, which has a generally tubular shape, for example, a cylindrical shape with round cross section. A pump chamber 14, in which liquid to be delivered is taken up during a suction or uptake cycle and from which liquid to be delivered is ejection during an ejection cycle, is formed in the pump body 12.

An inlet valve 18 is inserted into the pump body 12 at an end area 16 of the pump body 12 shown in the left-hand part of FIG. 1 and is advantageously fixed thereto in a fluid-tight manner. An outlet valve 22 is inserted into the pump body 12 at the end area 20 shown in the right-hand part of FIG. 1 and is advantageously fixed thereto in a fluid-tight manner. The inlet valve 18 and the outlet valve 22 are designed as nonreturn valves and comprise a valve body 24 and 26, respectively, with a respective valve seat 28 and 30 formed therein. A respective valve member 32 and 34 designed, for example, as a sphere is prestressed by a respective prestressing spring 36 and 38 against the respective valve seat 28 and 30 and thus closes an inlet channel 40 in case of the inlet valve 18 and an outlet channel 42 in case of the outlet valve 22.

A magnetic field-generating arrangement generally designated by 44 is provided such that it surrounds the pump body 12 or is arranged in the area around same. This arrangement may comprise one or more electrically excitable coils 46, which can be electrically excited to generate a magnetic field M shown in FIG. 2.

The pump body 12, which is tubular and advantageously has a cylindrical design, is made, at least in some areas, preferably entirely of magnetic shape memory material. For example, an NiMnGa alloy may be used for this. Such magnetic shape memory material can be brought from an initial state into a deformed state by generating a magnetic field. If the magnetic field M is generated, as this is shown, for example, by the comparison of FIGS. 1 and 2, starting from the initial state shown in FIG. 1 and also in FIG. 3*a*, with essentially round inner cross-sectional geometry of the pump body 12, this leads to a deformation of the pump body 12 such that an essentially elliptical cross-sectional geometry is obtained, as this can be recognized in FIG. 3A as well as in FIG. 2, for example, where the magnetic field M acts on this pump body. The deformation of the pump body 12 generated by the magnetic field M has a maximum deformation where the magnetic field M is directed essentially at right angles to the wall 13 of the pump body 12, i.e., in the middle area in FIG. 3B. The deformation of the magnetic shape memory material brought about by the magnetic field M has a minimum deformation in the edge areas, i.e., where the magnetic field M extends essentially tangentially to the wall 13 of the pump body 12. The deformation brought about by the magnetic field M, i.e., the flattening of the pump body 12 in its area on which the magnetic field M acts in this case, also leads to a longitudinal expansion of the pump body 12 in the direction of the longitudinal axis L thereof, which can also be recognized in FIG. 1. The extent of the deformation of the pump body 12 by the magnetic field M, i.e., also the extent of the change in the volume of the pump chamber 14 formed in the pump body 12, depends on the intensity of the magnetic field M. The higher the field intensity of the magnetic field M, the greater is the change in shape brought about thereby and hence also the change in the pump chamber volume.

The transition from the state with round inner cross-sectional geometry to a state with elliptical inner cross-sectional geometry leads to a change in the volume of the pump chamber 14. If the pump chamber 14 was filled with liquid in the initial state shown in FIG. 3A, the transition to the flattened deformed state shown in FIG. 3B with reduced pump chamber volume causes liquid present in the pump chamber 14 to be pressurized and a quantity of liquid corresponding to the change in the pump chamber volume to be ejected via the outlet valve 22 while the prestressing force of the valve spring 38 is overcome. To end such an ejection cycle, the generation of the magnetic field M by the magnetic field-generating arrangement 44 is ended.

Figure 3A:
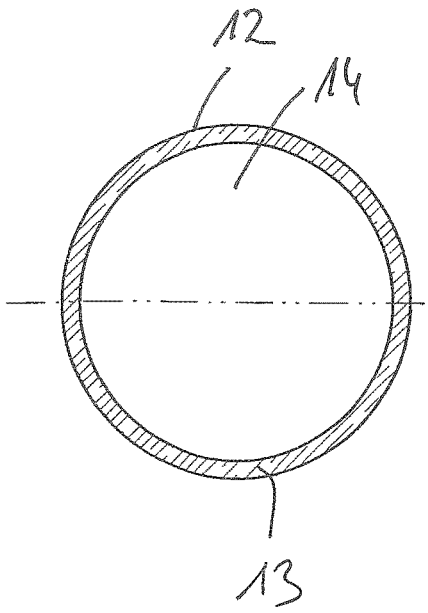
FIG. 3A is a cross-sectional view of a pump body that is in a state without magnetic field in FIG. 1.
Figure 3B:
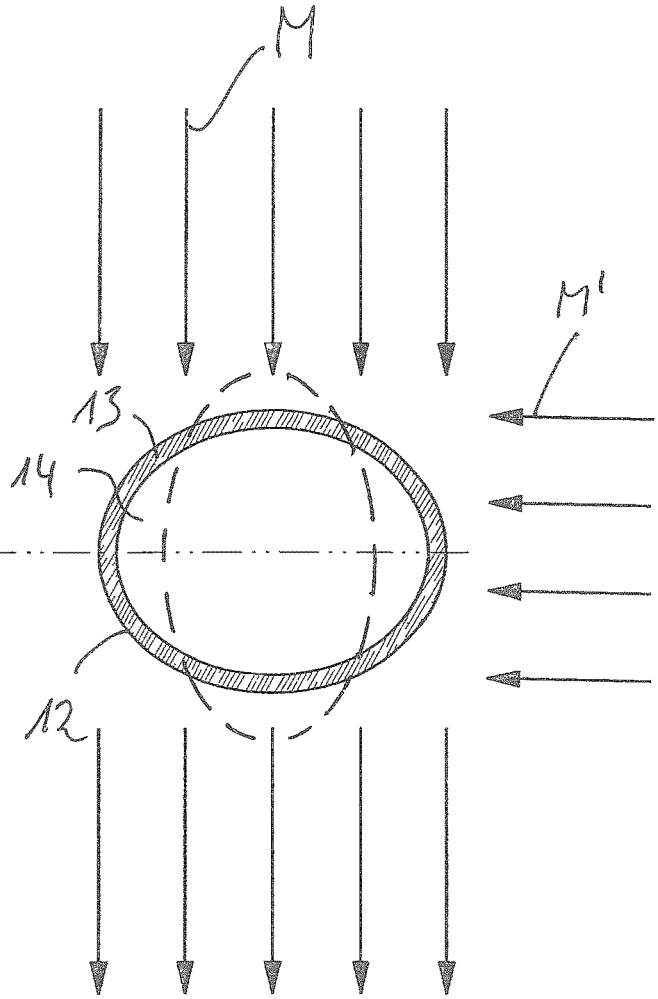
FIG. 3B is a cross-sectional view of a pump body that is in a state with magnetic field.

To return the pump body 12 into an initial state, a magnetic field M' with a different orientation, for example, at right angles to the magnetic field M in FIG. 3B, can be generated, which brings about a corresponding reverse deformation of the pump body 12. The magnetic field-generating arrangement 44 may comprise for this one or more additional coils, which are not shown in the figures, and which are positioned such that a magnetic field M' with a correspondingly different magnetic field orientation can be generated. The change in the shape of the pump body 12 brought about by the magnetic field M' is again subject to the same specifications, namely, a maximum deformation is generated where the magnetic field M' is directed essentially at right angles to the wall 13 of the pump body 12, whereas a minimal change in shape is brought about where the magnetic field M' extends essentially tangentially to the wall 13 of the pump body 12. The magnetic field M' will therefore generate essentially such a deformation of the pump body 12 that the pump body 12 reaches another deformed state indicated by broken lines in FIG. 3B, in which the pump body 12 will likewise have an essentially elliptical cross-sectional geometry, but with a different orientation of the large half axes in this case, in the area in which the magnetic field M' acts on pump body 12. Consequently, an alternating deformation takes place between two deformed states in case of generating the deformation of the pump body 12 in this manner by two magnetic fields M, M', which are oriented, for example, at right angles to one another, and alternating exposure to these two magnetic fields M, M', where one of the two deformed states can be considered to be an initial state in the sense of the present invention, and the other can be considered to be a deformed state. To make it possible to utilize the effect of a change in the pump chamber volume, the magnetic fields M, M' advantageously have different field intensities, so that the deformation brought about in one of the two states fills the pump chamber volume, on the one hand, and this volume does, in fact, differ from the deformation and hence also from the pump chamber volume present in the other state.

Figure 2:
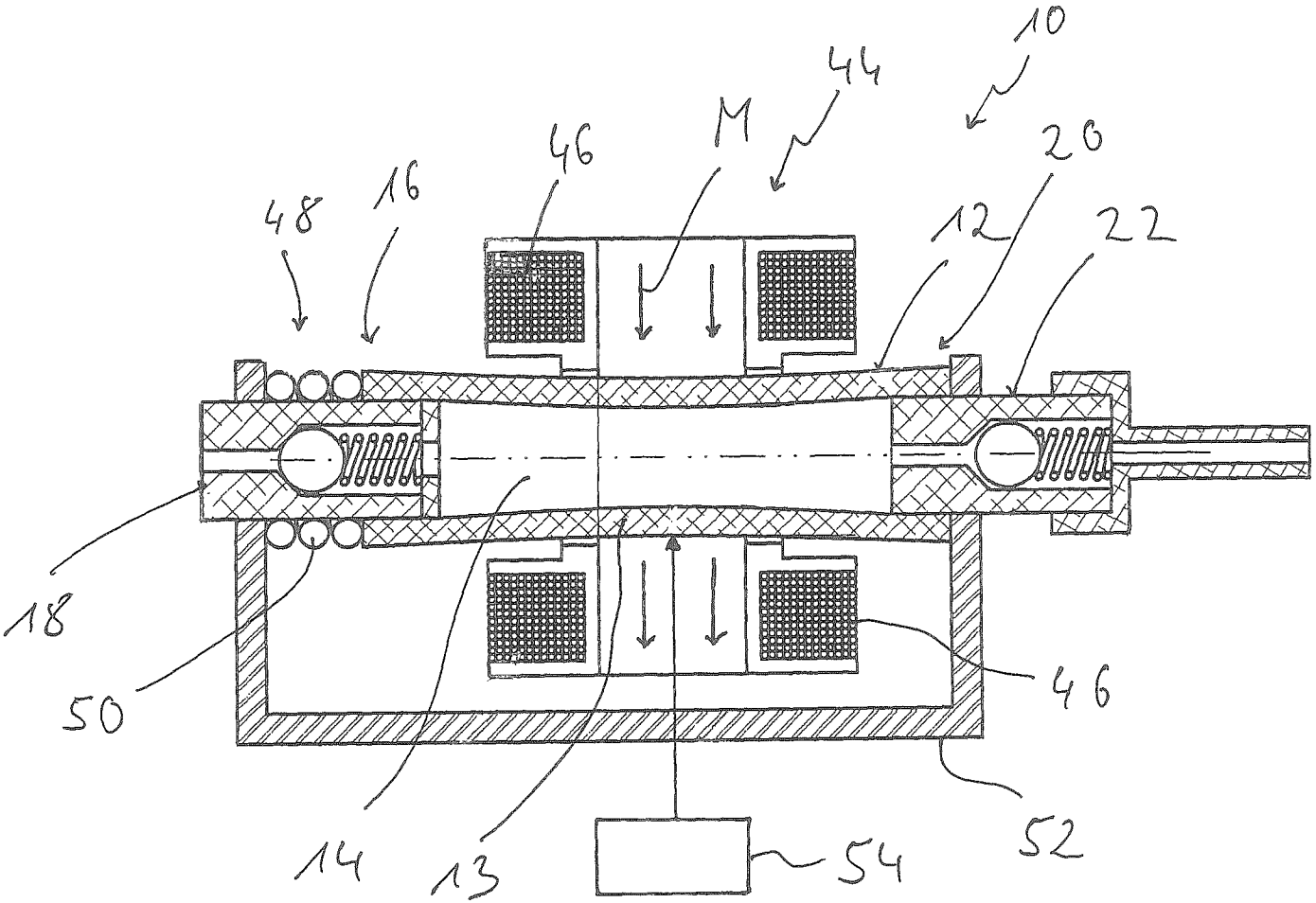
FIG. 2 is a view corresponding to FIG. 1 in a state with magnetic field.

As an alternative or in addition, the reverse deformation of the pump body 12 into its initial state shown in FIG. 3A can be achieved by a prestressing arrangement 48 shown in FIG. 2. This comprises a prestressing spring 50, which is supported at a housing 52, on the one hand, and at the end area 16 of the pump body 12, on the other hand, and thus it exerts an axial load on the pump body 12 in an oriented manner in the direction of the longitudinal axis L of the pump body 12. The inlet valve 18 is fixed in a fluid-tight manner at the end area 16 of the pump body 12, e.g., by bonding, and is displaceable in relation to the housing 52.

The housing 52 can axially support the other end area 20 of the pump body to provide an abutment. The housing 52 may be rigidly connected in this area with the pump body 12 or/and with the outlet valve 22 fixed in it in a fluid-tight manner, e.g., by bonding. The spring 50 counteracts the longitudinal expansion of the pump body 12 brought about during the generation of the magnetic field M, i.e., it loads same back into a state with smaller extension in the direction of its longitudinal axis L, which causes, when no magnetic field M is generated, the pump body 12 to undergo a reverse deformation back into its initial state shown in FIG. 3A.

With the design of a metering pump according to the present invention, which uses the deformation of magnetic shape memory material brought about by the application of a magnetic field to generate a change in the volume of a pump chamber, it becomes possible to exactly determine the quantity of liquid to be delivered. It would be possible to proceed for this such that a defined, preset magnetic field or a defined, preset mechanical load is used for each work cycle for deformation from the initial state and for deformation into the initial state, so that exactly the same quantity of liquid is taken up in the pump chamber 14 and also ejected from same during each work cycle. To change the extent of deformation of the pump body 12, it would also be possible, in principle, to vary the intensity of the magnetic field M and, of course, also the intensity of a magnetic field that brings about a reverse deformation or of a mechanical load that brings about a reverse deformation, so that different liquid volumes can also be delivered, in principle, during the work cycles to be performed one after another.

A deformation detection arrangement 54 schematically indicated in FIG. 1 may be provided to detect the extent of deformation of the pump body 12. This may be designed, for example, such that it measures the electric resistance of the material of which the pump body 12 is made, especially in the area in which the magnetic field M leads to the deformation of that material. The electric resistance of the magnetic shape memory material, with which the pump body 12 is made, changes as a function of the deformation of the pump body 12 brought about by the magnetic field M and is thus a direct indicator of the change in the volume of the pump chamber 14, which is associated with such a deformation. By detecting this electric resistance, information is consequently provided, which directly reflects the change brought about in the pump chamber volume 14 during each work cycle and hence also the volume of the liquid ejected from said pump chamber. This information can be used, for example, in a regulation loop in order to ensure during the heating operation of a vehicle heater that the necessary quantity of fluid is indeed being sent in the direction of a burner area of a vehicle heater.

While specific embodiments of the invention have been shown and described in detail to illustrate the application of the principles of the invention, it will be understood that the invention may be embodied otherwise without departing from such principles.

What is claimed is:

1. A pump for delivering liquid fuel for a vehicle heater, the pump comprising:

a tubular pump body extending along a longitudinal axis and providing a pump chamber, wherein the pump body is made entirely of a magnetic shape memory material; and a means for generating a magnetic field comprising at least one electrically excitable coil for bringing the magnetic shape memory material of the pump body from an initial state into a deformed state by electrically exciting the at least one electrically excitable coil for generating the magnetic field, wherein a pump chamber volume in the deformed state differs from the pump chamber volume present in the initial state;

a means for resetting the pump body into the initial state comprising a prestressing spring exerting an axial load on an axial end of the pump body for prestressing the pump body into the initial state;

a deformation detection arrangement for measuring an electric resistance of the pump body in an area of the pump body deformed by the magnetic field generated by the means for generating the magnetic field to provide information representing the deformation of the pump body.

2. A pump in accordance with claim 1, wherein the pump chamber volume is smaller in the deformed state than in the initial state.

3. A pump in accordance with claim 1, wherein the pump body has an essentially round inner cross-sectional geometry in the initial state.

4. A pump in accordance with claim 1, further comprising:

an inlet valve leading to the pump chamber; and an outlet valve leading out of the pump chamber.

5. A pump in accordance with claim 4, wherein at least one of the inlet valve and the outlet valve comprises a nonreturn valve.

6. A pump in accordance with claim 1, wherein the pump body is made with NiMnGa alloy material at least in some areas.

7. A pump for delivering liquid fuel for a vehicle heater, the pump comprising:

a substantially tubular pump body comprising a pump chamber, each and every portion of said pump body comprising a magnetic shape memory material, said pump body comprising an axial end;

a magnetic field-generating generator comprising at least one electrically excitable coil, wherein said magnetic shape memory material of said pump body changes said pump body from an initial state into a deformed state when said magnetic field-generating generator generates a magnetic field via said at least one electrically excitable coil, said pump chamber having an initial pump chamber volume in said initial state, said pump chamber having a deformed state pump chamber volume in said deformed state, said deformed state pump chamber volume being different from said initial pump chamber volume;

a prestressing spring, said pump body changing from said deformed state to said initial state via an axial load exerted on said axial end of said pump body via said prestressing spring;

a deformation detection arrangement for measuring an electric resistance of said pump body in an area of said pump body deformed by said magnetic field generated by said magnetic field-generating generator to provide information representing deformation of said pump body.

8. A pump in accordance with claim 7, wherein said deformed state pump chamber volume is smaller than said initial state pump chamber volume, wherein deformation of said pump body produces a pumping action for moving fluid in said pump chamber, wherein a deformation force generated via said magnetic field-generating mechanism is applied exclusively to said pump body.

9. A pump in accordance with claim 7, wherein said pump body has an essentially round inner cross-sectional geometry in said initial state.

10. A pump in accordance with claim 7, further comprising:

an inlet valve leading to the pump chamber; and an outlet valve leading out of the pump chamber.

11. A pump in accordance with claim 10, wherein at least one of said inlet valve and said outlet valve comprises a nonreturn valve.

12. A pump for delivering liquid fuel for a vehicle heater, the pump comprising:

a substantially tubular pump body comprising a pump chamber, said pump body being completely made of a magnetic shape memory material, said pump body comprising an axial end; and a magnetic field-generating mechanism comprising at least one electrically excitable coil, wherein said magnetic shape memory material of said pump body changes said pump body from an initial state into a deformed state when said magnetic field-generating mechanism generates a magnetic field via electrically exciting said at least one electrically excitable coil, said pump chamber having an initial pump chamber volume in said initial state, said pump chamber having a deformed state pump chamber volume in said deformed state, said deformed state pump chamber volume being different from said initial pump chamber volume;

a prestressing spring, said pump body changing from said deformed state to said initial state via an axial load exerted on said axial end of said pump body via said prestressing spring;

a deformation detection arrangement for measuring an electric resistance of said pump body in an area of said pump body deformed by said magnetic field generated by said magnetic field-generating mechanism to provide information representing deformation of said pump body.

13. A pump in accordance with claim 12, wherein a pumping force for moving fluid in said pump chamber is provided exclusively by deformation of said pump body, wherein a deformation force generated via said magnetic field-generating mechanism is applied exclusively to said pump body.

14. A pump in accordance with claim 12, further comprising:

a housing comprising a first housing portion and a second housing portion, said first housing portion being located opposite said second housing portion, said pump body comprising another axial end, said another axial end being located opposite said axial end, said another axial end being in direct contact with said second housing portion, said prestressing spring comprising a first spring end portion and a second spring end portion, said axial end being in direct contact with said first spring end portion, said second spring end portion being in direct contact with said first housing portion.

15. A pump in accordance with claim 12, further comprising:

a housing, said pump body comprising another axial end, said another axial end engaging a portion of said housing, said prestressing spring engaging another portion of said housing, said prestressing spring extending from said another portion of said housing to said axial end of said pump body.

16. A pump in accordance with claim 15, further comprising:

a first valve body comprising a first valve body outer surface, at least a portion of said first valve body being located adjacent to said another portion of said housing, said prestressing spring extending about said first valve body outer surface;

a second valve body, at least a portion of said second valve body being located adjacent to said portion of said housing.

17. A pump in accordance with claim 7, further comprising:

a housing comprising a first housing portion and a second housing portion, said first housing portion being located opposite said second housing portion, said pump body comprising another axial end, said another axial end being located opposite said axial end, said another axial end being in direct contact with said second housing portion, said prestressing spring comprising a first spring end portion and a second spring end portion, said axial end being in direct contact with said first spring end portion, said second spring end portion being in direct contact with said first housing portion.

18. A pump in accordance with claim 7, further comprising:

a housing, said pump body comprising another axial end, said another axial end engaging a portion of said housing, said prestressing spring engaging another portion of said housing, said prestressing spring extending from said another portion of said housing to said axial end of said pump body.

19. A pump in accordance with claim 18, further comprising:

a first valve body comprising a first valve body outer surface, at least a portion of said first valve body being located adjacent to said another portion of said housing, said prestressing spring extending about said first valve body outer surface;

a second valve body, at least a portion of said second valve body being located adjacent to said portion of said housing.

20. A pump in accordance with claim 1, further comprising:

a housing, said pump body comprising another axial end, said another axial end engaging a portion of said housing, said prestressing spring engaging another portion of said housing, said prestressing spring extending from said another portion of said housing to said axial end of said pump body, wherein said prestressing spring is compressed when said pump changes from said initial state to said deformed state.

* * * * *